US006453897B1

(12) United States Patent
Kanno

(10) Patent No.: US 6,453,897 B1
(45) Date of Patent: Sep. 24, 2002

(54) INTAKE AIR PRESSURE SENSOR FOR ENGINE

(75) Inventor: Isao Kanno, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/686,753

(22) Filed: Oct. 10, 2000

(30) Foreign Application Priority Data

Oct. 8, 1999 (JP) ..... 11-288542

(51) Int. Cl.[7] ..... F02D 41/26
(52) U.S. Cl. ..... 123/684; 73/118.2
(58) Field of Search ..... 73/118.2, 31.04; 123/684, 435

(56) References Cited

U.S. PATENT DOCUMENTS 4,010,717 A * 3/1977 Taplin ..... 123/684
4,412,520 A * 11/1983 Mitsuyasu et al. ..... 73/118.2
4,413,602 A * 11/1983 Inoue et al. ..... 123/486
4,930,482 A * 6/1990 Kako ..... 123/488
4,936,278 A * 6/1990 Umeda ..... 123/489
5,709,198 A * 1/1998 Sagisaki et al. ..... 123/684
5,829,402 A * 11/1998 Takahashi et al. ..... 123/184.24
5,937,825 A 8/1999 Motose
5,941,223 A 8/1999 Kato
5,983,878 A 11/1999 Nonaka et al.
6,015,319 A 1/2000 Tanaka
6,041,758 A * 3/2000 Ishii ..... 123/492
6,279,372 B1 * 8/2001 Zhang ..... 73/118.2
6,286,492 B1 * 11/2001 Kanno ..... 123/684

OTHER PUBLICATIONS

Eric Chowanietz; "Automobile Electronics", Published 1995; pp. 112 & 115.

* cited by examiner

*Primary Examiner*—Erick Solis
(74) *Attorney, Agent, or Firm*—Knobbe, Martens, Olson & Bear, LLP

(57) ABSTRACT

An engine includes an electronic controller which samples the pressure in the induction system once per rotation of the crankshaft. The controller is configured to determine the minimum voltage signal output by the pressure sensor. The controller then uses the minimum pressure sensed by the pressure sensor to control the fuel injection of the engine. The controller may include two and/or three dimensional maps for predicting the appropriate timing for sampling the pressure sensor. The engine also includes a smoothing system so as to provide for more accurate sampling of the pressure within the induction system.

29 Claims, 9 Drawing Sheets

INTAKE AIR PRESSURE SENSOR FOR ENGINE

PRIORITY INFORMATION

This application is based on and claims priority to Japanese Patent Application Number 11-288542, filed Oct. 8, 1999.

BACKGROUND OF THE INVENTION

1. Field of the Invention

The present invention is directed to an intake air pressure sensor assembly for an engine, and in particular, an air pressure sensor assembly for a fuel-injected engine which communicates with a controller for controlling the fuel injectors based on a detected intake air pressure.

2. Description of Related Art

In all fields of engine design, there is an increasing emphasis on obtaining more effective emission control, better fuel economy, and at the same time, continued high or higher power output. This trend has resulted in the substitution of fuel injection systems for carburetors as the charge former for internal combustion engines. Typically, fuel injection systems for internal combustion engines receive input from a variety of sensors included on the engine which are configured to output data which reflect the operating conditions of the engine. For example, a fuel-injected engine may include an engine speed sensor, an air temperature sensor, a throttle position sensor, an engine temperature sensor, and an air flow sensor. The controller for the engine monitors each of these sensors to determine the appropriate fuel injection timing and duration corresponding to the detected conditions. Thus, as the accuracy of the sensors and the processing of the data from the sensors is increased, so is the accuracy of the fuel injection duration and timing calculations and the emissions and the fuel efficiency of the engine.

Among the various types of data monitored by the controllers of fuel-injected engines, accurate determination of air flow into the engine poses a unique challenge. Although the flow of induction air into an engine is controlled by a throttle valve, it is imperative to determine the mass flow rate of air into the engine in order to determine the appropriate mass of fuel required to accurately produce the desired air/fuel ratio. In some applications, the mass flow rate of air into the engine is estimated by detecting the absolute pressure within the induction manifold (manifold absolute pressure or "MAP") which is proportional to the total volume of air drawn into the engine. The absolute pressure is then used, in combination with other data collected from various other sensors, by the engine controller in order to calculate the mass air flow rate into the engine. Such calculations are known as volume-density computations or speed-density computations.

Recently, air flow meters have been used with fuel-injected engines which directly measure air flow rates of induction air into the engine. For example, known air flow meters include suspended-plate-type flow sensors, swinging-gate-type air flow sensors, and mass-flow sensors. However, these flow meters provide additional bulk and make engines more expensive to manufacture.

SUMMARY OF THE INVENTION

A need therefore exists for a less expensive fuel injection control system for an engine which accurately determines a flow rate of induction air into the engine.

One aspect of the present invention includes the realization that the timing during a combustion cycle, i.e., the crank angle position of a crankshaft, at which a minimum induction air pressure is generated within an internal combustion engine varies substantially in accordance with changes in engine speed and another engine operation characteristic. For example, in a four-cycle internal combustion engine, air is drawn into the respective cylinders when the intake valve is open and the piston moves downwardly within the cylinder, i.e., during the "intake stroke." The intake stroke occurs once very two revolutions of the crankshaft. Thus, within the engine operation speeds between 1,000 rpm and 6,000 rpm, air is drawn through the induction system in pulses of a frequency from about 500 times per minute to 3,000 times per minute.

As induction air is drawn into the induction system, the absolute pressure generated in the induction system predictably falls in accordance with the vacuum generated by the downward movement of the piston. The actual mass flow rate attained by the induction air is affected by numerous conditions. For example, although the diameter of the cylinder and the stroke length of the piston of an internal combustion engine remain constant during operation, the atmospheric air pressure, temperature, and density may change in accordance with environmental conditions. Internal combustion engines having the same cylinder diameter and stroke length may also have differently configured induction systems with different aerodynamic resistance. Internal combustion engines also may incorporate variable valve timing for at least the intake valves, thus affecting the flow of induction air differently at different engine speeds. Accordingly, the minimum absolute pressure generated in the induction system is a result of numerous factors which can affect the mass flow rate of induction air through the induction system.

Significantly, it has been found that the timing at which the minimum pressure in the induction system is generated predictably varies according to the position of a throttle valve in the induction system, as well as engine speed. Additionally, it has been found that an output signal from a conventional air pressure sensor disposed in the induction system can be affected so as to output a signal that includes fluctuations but do not accurately reflect the air pressure in the induction system, thus generating a further unpredictable variation in the output signal from the pressure sensor. Thus, an engine constructed in accordance with a further aspect of the present invention includes an engine body defining at least one combustion chamber therein, a crankshaft rotatably journaled at least partially within the engine body, and an induction system configured to guide induction air into the combustion chamber. A pressure sensor assembly is configured to detect the pressure of an air flow in the induction system and to output a pressure signal indicative of the pressure detected. The engine also includes a charge former configured to supply a fuel charge for combustion in the combustion chamber. A controller controls the charge former as a function of at least the output signal of the pressure sensor. The engine also includes a smoothing system configured to smooth at least one of the pressure signals from the pressure sensor and the air flow in the induction system in the vicinity of the pressure sensor assembly.

By including a smoothing system that is configured to smooth at least one of the pressure signal from the pressure sensor and the air flow in the induction system in the vicinity of the pressure sensor assembly, the present invention provides more accurate data for the controller to use in controlling the charge former. Additionally, the higher level of accuracy achieved by including such a smoothing system, allows the controller to be manufactured with less sophisticated electronics, e.g., a less expensive processor.

As is known in the art, injecting an air-fuel mixture that is stoichiometrically perfect into an internal combustion engine provides the highest specific power output and the lowest emissions. It is also well known in the art that known internal combustion engines do not reliably produce air-fuel charges with stoichiometrically perfect air-fuel mixtures. Additionally, if an air-fuel charge combusted in an internal combustion engine is excessively "lean," i.e., there is too little fuel in the charge, the engine can be damaged through "detonation," for example. Thus, it is common in the art to configure some charge formers to produce "rich" air-fuel charges. That is, some types of charge formers produce air-fuel charges that have more fuel than an air-fuel charge which is stoichiometrically perfect. Thus, these prior charge formers avoid damaging lean fuel charges by erring on the side of rich fuel charges, thereby protecting the engine but wasting fuel and discharging un-burnt fuel with the exhaust gases.

By constructing an engine in accordance with the present invention, more accurate fuel injection control is possible, thus allowing the engine controller to produce fuel charges that are more stoichiometrically correct, thus reducing fuel consumption and improving emissions of the engine.

Further aspects, features, and advantages of the present invention will become apparent from the detailed description of the preferred embodiments which follow.

BRIEF DESCRIPTION OF THE DRAWINGS

The above-mentioned and other features of the invention will now be described with reference to the drawings of the preferred embodiments of the present outboard motor. The illustrated embodiment of the outboard motor is intended to illustrate, but not to limit the invention. The drawings contain the following figures.

DETAILED DESCRIPTION OF THE PREFERRED EMBODIMENTS OF THE INVENTION

Figure 1:
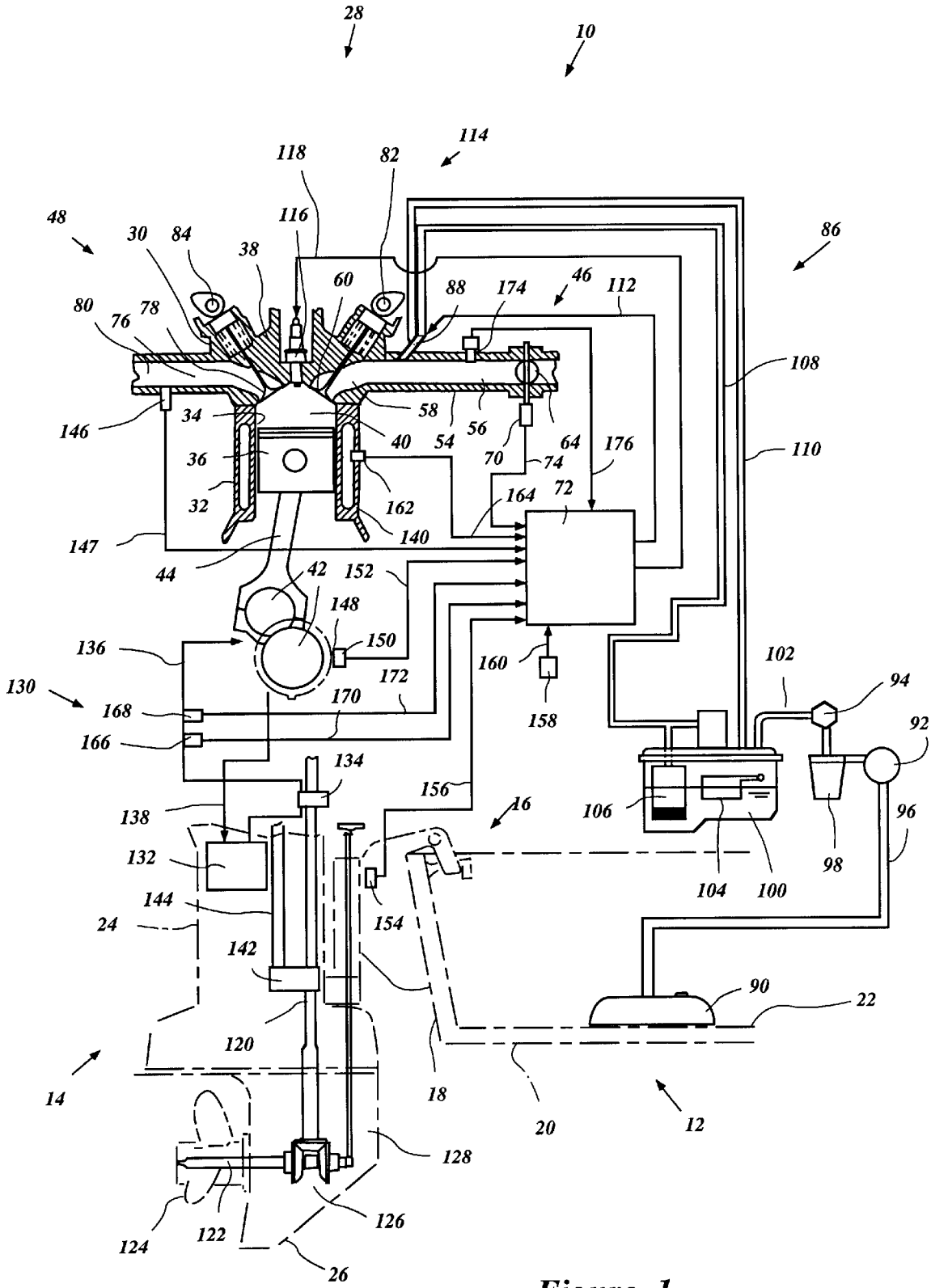
FIG. 1 is a schematic view showing an outboard motor including an engine, configured in accordance with a preferred embodiment of the invention. The engine, in part, and the ECU, are shown generally in the upper half of the figure. The outboard motor, in part, and a watercraft are shown in the lower half of the figure. The ECU, and the fuel injection system, link the two views together. The outboard motor and the associated watercraft are illustrated in phantom.

With initial reference to FIG. 1, an outboard motor 10 for powering a watercraft 12 is illustrated. The outboard motor 10 advantageously has a smoothing system arranged and configured in accordance with certain features, aspects, and advantages of the present invention. The outboard motor 10 provides an exemplary environment in which the smoothing system has particular utility. The smoothing system of the present invention may also find utility in applications using internal combustion engines, such as, for example but without limitation, personal watercraft, small jet boats, off-road vehicles, racing vehicles, and heavy construction equipment.

In the illustrated embodiment, the outboard motor 10 comprises a drive unit 14 and a bracket assembly 16. Although schematically shown in FIG. 1, the bracket assembly 16 comprises a swivel bracket and a clamping bracket. The swivel bracket supports the drive unit 14 for pivotal movement about a generally vertically extending steering axis. The clamping bracket, in turn, is affixed to the transom 18 of the watercraft 12 and supports the swivel bracket for pivotal movement about a generally horizontally extending axis. A hydraulic tilt system can be provided between the swivel bracket and the clamping bracket to tilt up or down the drive unit 14. If this tilt system is not provided, the operator may tilt the drive unit 14 manually. Since the construction of the bracket assembly 16 is well known in the art, a further description is not believed to be necessary to enable those skilled in the art to practice the invention.

As used throughout this description, the terms "forward," "front" and "fore" mean at or to the forward side of the bracket assembly 16, and the terms "rear," "reverse" and "rearwardly" mean at or to the opposite side of the front side, unless indicated otherwise.

As shown in FIG. 1, the associated watercraft 12 is a powerboat. The watercraft 12 has a hull 20 that defines a deck 22. The watercraft 12 may include any number of seats disposed on the deck 22. Preferably, a steering wheel is mounted at an appropriate position on the deck 22. The steering wheel is coupled to the bracket assembly 16 of the outboard motor 10 so that the operator can remotely steer the motor 10 to the left and right.

With reference to FIG. 1, the drive unit 14 will now be described in detail. The drive unit 14 includes a driveshaft housing 24 and a lower unit 26. A powerhead 28 is disposed atop the drive unit 14 and includes an engine 30, a top protective cowling and a bottom protective cowling (not shown).

The engine 30 operates on a four-stroke combustion principle and powers a propulsion device. As shown in FIG. 1, the engine 30 includes a cylinder block 32 which defines at least one cylinder bore 34. In the illustrated embodiment, the cylinder block 44 defines four cylinder bores 34, which are generally horizontally extending and spaced generally vertically from each other. As such, the engine 30 is an L4 (in-line, four-cylinder) type.

It is to be noted that the engine may be of any type (V-type, W-type), may have other numbers of cylinders, and/or may operate under other principles of operation (two-cycle, rotary, or diesel principles).

A piston 36 reciprocates in each cylinder bore 34. A cylinder head assembly 38 is affixed to one end of the cylinder block 32 and defines four combustion chambers 40 with the pistons 36 and the cylinder bores 34. The other end of the cylinder block 32 is closed with a crankcase member (not shown) defining a crankcase chamber therein.

A crankshaft 42 extends generally vertically through the crankcase chamber and is journaled to rotate at least partially within the crankcase chamber. The crankshaft 42 is connected to the pistons 36 by connecting rods 44 and rotates with the reciprocal movement of the pistons 36 within the cylinder bores 34. The crankcase member is preferably located at the forwardmost position of the powerhead 28, and the cylinder block 32 and the cylinder head assembly 38 preferably extend rearwardly from the crankcase member.

The engine 30 includes an air induction system 46 and an exhaust system 48. The air induction system 46 is configured to supply air charges to the combustion chambers 40.

Figure 2:
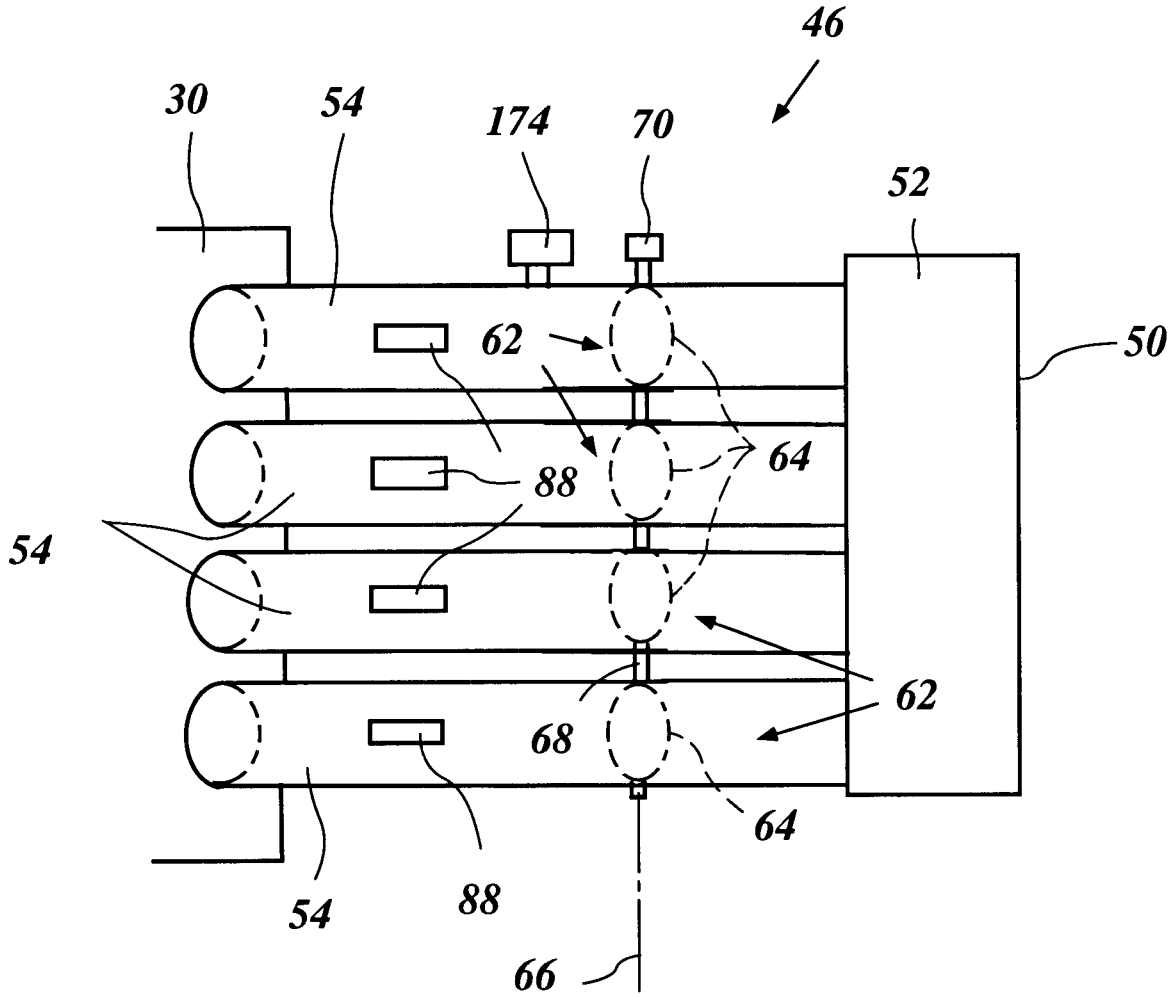
FIG. 2 is a schematic illustration of an induction system of the engine shown in FIG. 1, with a pressure sensor mounted thereon.

With reference to FIG. 2, the induction system 46 includes a plenum chamber member 50 which defines a plenum chamber 52 therein. Four main intake runners 54 extend from the plenum chamber 52 and define a corresponding number of induction air intake passages 56 therein. The intake passages 56 extend from the plenum chamber 52 to a plurality of intake ports 58 formed in the cylinder head assembly 38.

With reference to FIG. 1, the intake ports 58 are opened and closed by intake valves 60. When the intake ports 58 are opened, air from the intake passages 56 and intake ports 58 flows into the combustion chambers 40.

The plenum chamber member 50 preferably includes an inlet opening that opens to an interior of the cowling of the outboard motor 10. The plenum chamber member 50 functions as an intake silencer and/or a collector of air charges.

Preferably, the plenum chamber member 50 is positioned on a forward side of the engine 30 and the induction passages 56 extend rearwardly from the plenum chamber member 50 to the intake ports 58. As shown in FIG. 2, the respective intake runners 54 are spaced vertically from each other.

As shown in FIG. 2, a throttle body 62 is provided within each intake runner 54 The respective throttle bodies 62 each support throttle valves 64 therein for pivotal movement about an axis 66 of a valve shaft 68 which extends generally vertically through each of the respective throttle bodies 64.

The throttle valves 64 are operated via a throttle cable (not shown) and preferably a nonlinear control mechanism (not shown). The throttle cable is connected to a throttle shift lever (not shown) that may be provided on a control handle connected to the outboard motor 10 or to a control mast (not shown) provided on the deck 22 of the watercraft 12.

With reference to FIG. 2, a throttle valve position sensor 70 is arranged atop of the throttle valve shaft 68. A signal from the position sensor 70 is sensed by an ECU 72 (FIG. 1) via a throttle position data line 74 for use in controlling various aspects of engine operation including, for example, but without limitation, fuel injection control, which will be described later. The signal from the throttle valve position sensor 70 corresponds to the engine load in one aspect, as well as the throttle opening. The ECU 72 preferably is mounted within the powerhead 28.

The air induction system 46 may also include a bypass passage or idle air supply passage that bypasses the throttle valves 64, although such is omitted from FIG. 2. The engine 30 also preferably includes an idle air adjusting unit (not shown) which is controlled by the ECU 72.

In operation, air is introduced into the powerhead 28 and passes through the inlet opening of the plenum chamber member 50. During operation of the engine 30, an air charge amount is controlled by the throttle valves 64 to meet the requirements of the engine 30. The air charge then flows through the runners 54 into the intake ports 58.

As described above, the intake valves 60 are provided at the intake ports 58. When the intake valves 60 are opened, the air is supplied to the combustion chambers 40 as an air charge. Under the idle running condition, the throttle valves 64 are generally closed. The air, therefore, enters the ports 58 through the idle air adjusting unit (not shown) which is controlled by the ECU 72. The idle air charge adjusted in the adjusting unit is then supplied to the combustion chambers 40 via the intake ports 58.

With reference to FIG. 1, the exhaust system 48 is configured to discharge burnt gases or exhaust gases outside of the outboard motor 10 from the combustion chambers 40. Exhaust ports 76 are defined in the cylinder head assembly 38 and are opened and closed by exhaust valves 78. When the exhaust ports 76 are opened, the combustion chambers 40 communicate with a single or multiple exhaust passages 80 which guide the exhaust gases downstream through the exhaust system 48.

An intake camshaft 82 and an exhaust camshaft 84 are provided to control the opening and closing of the induction valves 60 and the exhaust valves 78, respectively. The camshafts 82, 84 extend approximately vertically and parallel with each other. The camshafts 82, 84 have cam lobes that act against the valves 60, 78, at predetermined timings to open and close the respective ports. The camshafts 82, 84 are journaled on the cylinder head assembly and are driven by the crankshaft 42 via a camshaft drive unit (not shown).

With reference to FIG. 1, the engine 30 also includes a fuel injection system 86. The fuel injection system 86 includes four fuel injectors 88 which have injection nozzles exposed to the intake ports 58 so that injected fuel is directed toward the combustion chambers 40. A main fuel supply tank 90 is part of the fuel injection system and is placed in the hull 20 of the associated watercraft 12. Although any place on the deck 22 is available, in the illustrated embodiment, the fuel tank 90 is positioned near the transom 18 of the watercraft 12.

Fuel is drawn from the fuel tank 90 by a first low-pressure pump 92 and a second low-pressure pump 94 through a first fuel supply conduit 96. The first low-pressure pump 92 is a manually operated pump. The second low-pressure pump 94 is a diaphragm-type pump operated by one of the intake and exhaust camshafts 82, 84. A quick-disconnect coupling (not shown) is preferably provided in the first fuel conduit 96. A fuel filter 98 is also positioned in the conduit 96 at an appropriate location.

From the low-pressure pump 94, fuel is supplied to a vapor separator 100 through a second fuel supply conduit 102. At the vapor separator end of the conduit 102, a float valve 104 is provided which is operated by a float so as to maintain a uniform level of the fuel contained in the vapor separator 100.

A high-pressure fuel pump 106 is provided within the vapor separator 100 and pressurizes fuel within the vapor separator 100. The high-pressure fuel pump 106 is connected with the fuel injectors 88 through a fuel delivery conduit 108. Preferably, the conduit 108 itself forms a fuel rail connecting the fuel injectors 88 with the high-pressure fuel pump 106. The high-pressure fuel pump 106 is driven by an electric motor that is directly connected to the pump 106 at its lower end, as viewed in FIG. 1. The electric motor is activated by the ECU 72 and is controlled via a fuel pump control line (not shown).

A fuel return conduit 110 is also provided between the fuel injectors 88 and the vapor separator 100. Excess fuel that is not injected by the injectors 88 returns to the vapor separator 100 through the conduit 110. A pressure regulator may be provided so as to communicate with either the fuel supply conduit 108 or the fuel return conduit 110 to limit the pressure of the fuel delivered to the fuel injectors 88. The flow generated by the return of unused fuel from the fuel injectors aids in cooling the fuel injectors 88. The timing and duration of fuel injection is dictated by the ECU 72, which is described below in detail.

The fuel charge delivered by the fuel injectors 88 then enters the combustion chambers 40 with an air charge at the moment the intake valves 60 are opened. Since the fuel pressure is regulated by the pressure regulator, a duration during which the nozzles of the injectors 88 are opened is a factor determined by the 72 to measure the amount of fuel to be injected by the fuel injector 88. The duration and the injection timing are thus controlled by the ECU 72 through fuel injector control line 112. Preferably, the fuel injectors 88 are opened by solenoids, as is known in the art. Thus, the fuel injector control line 112 signals the solenoids to open according to the timing and duration determined by the ECU 72.

The engine 30 further includes an ignition system, indicated generally by the reference numeral 114. Four spark plugs 116 are fixed on the cylinder head assembly 38 and exposed into the respective combustion chambers 40. The spark plugs 116 ignite an air fuel charge at a timing as determined by the ECU 72 to burn the air fuel charge therein. For this purpose, the ignition system 114 preferably includes an ignition coil (not shown) interposed between the spark plugs 116 and the ECU 72 along a spark plug control line 118.

The engine 30 also preferably includes an AC generator (not shown) for generating electrical power. Additionally, the outboard motor 10 preferably includes a battery (not shown) for storing electrical energy from the AC generator and to supply electrical power to other electrical equipment including the ECU 72, the solenoids controlling the fuel injectors, and the ignition coil.

While not illustrated, the engine 30 also can include a recoil starter to drive the crankshaft 42 for starting the engine 30. A starter motor can be employed in addition or in the alternative to the recoil starter for the same purpose. The use of the starter motor is preferred when the present invention is employed with larger size engines. The recoil starter is operated by an operator of the watercraft 12 when the operator wants to start the engine 30.

Although not illustrated in FIG. 1, the driveshaft housing 24 depends from the powerhead and supports a driveshaft 120 which is driven by the crankshaft 42 of the engine 30. The driveshaft 120 extends generally vertically through the driveshaft housing 24. The driveshaft housing 24 also defines internal passages which form portions of the exhaust system 48.

The lower unit 26 depends from the driveshaft housing 24 and supports the propeller shaft 122 which is driven by the driveshaft 120. The propeller shaft 122 extends generally horizontally through the lower unit 26. In the illustrated embodiment, the propulsion device includes a propeller 124 that is affixed to an outer end of the propeller shaft 122 and is thereby driven.

A transmission 126 is provided between the driveshaft 120 and the propeller shaft 122. The transmission 126 couples together the two shafts 120, 122 which lie generally normal to each other (i.e., at a 90° angle) with a beveled gear combination.

A switch-over mechanism is provided for the transmission 126 to shift rotational directions of the propeller 124 between forward, neutral and reverse. The switch-over mechanism includes a shift cam (not shown), a shift rod 128 and a shift cable (not shown). The shift rod 128 extends generally vertically through the driveshaft housing 24 and the lower unit 26, while the shift cable extends outwardly from the cowling and is connected to a throttle/shift lever that is operable by the operator when the operator wants to shift the transmission's direction.

The lower unit 26 also defines an internal passage that forms a discharge section of the exhaust system 48. At engine speed above idle, the majority of the exhaust gases are discharged to the body of water surrounding the outboard motor 10 through the internal passage and finally through a hub of the propeller 124.

The engine 30 also preferably includes a lubrication system 130, which is schematically represented in FIG. 1. The lubrication system 130 is provided for lubricating certain portions of the engine 30, such as, for example, but without limitation, the pivotal joints of the connecting rods 44 with the crankshaft 42 within the crankcase and the walls of the cylinder bores 34.

The lubricant reservoir 132 is disposed at an appropriate location in the driveshaft housing 24. Lubricant in the reservoir 132 is drawn therefrom by a lubricant pump 134. In the illustrated embodiment, the lubricant pump 134 is driven by the driveshaft 120. However, the lubricant pump 134 may alternatively be driven by the crankshaft 42 or an electric motor (not shown). Lubricant from the lubricant pump 134 is directed to a lubricant supply line 136 and is delivered to various portions of the engine which benefit from circulating lubricant. After the lubricant has passed through the various engine galleries, the lubricant collects in the lubricant pan (not shown) provided at a lower end of the crankcase. Lubricant returns to the lubricant reservoir 132 via a return line 138. Thus, the lubrication system 130 defines a loop.

The outboard motor 10 also preferably includes a cooling system for cooling the heated portions of the engine 30, such as the cylinder block 32, the cylinder head assembly 38 and portions of the exhaust system 48. In the illustrated embodiment, a water jacket 140 is defined in the cylinder block 32 and is in thermal communication with the cylinder bores 34. A water pump 142 is driven by the driveshaft 120. Although not shown, a water inlet is provided in the lower unit 26 to draw cooling water from the body of water surrounding the motor 10. The water is supplied to the water jackets through a water supply conduit 144.

As noted above, the ECU 72 controls engine operations including fuel injection from the fuel injectors 88 and firing the spark plugs 116, according to various control maps stored in the ECU 72. In order to determine appropriate control scenarios, the ECU 72 utilizes such maps and/or indices stored within the ECU 72 in reference to data collected from various sensors.

Any type of desired control strategy can be employed for controlling the time and duration of fuel injection from the injectors 88 and the timing of firing the spark plugs 116; however, a general discussion of some engine conditions that can be sensed and some of the ambient conditions that can be sensed for engine control will follow. It is to be understood, however, that those skilled in the art will readily understanding how various control strategies can be employed in conjunction with the components of the invention.

Figure 3:
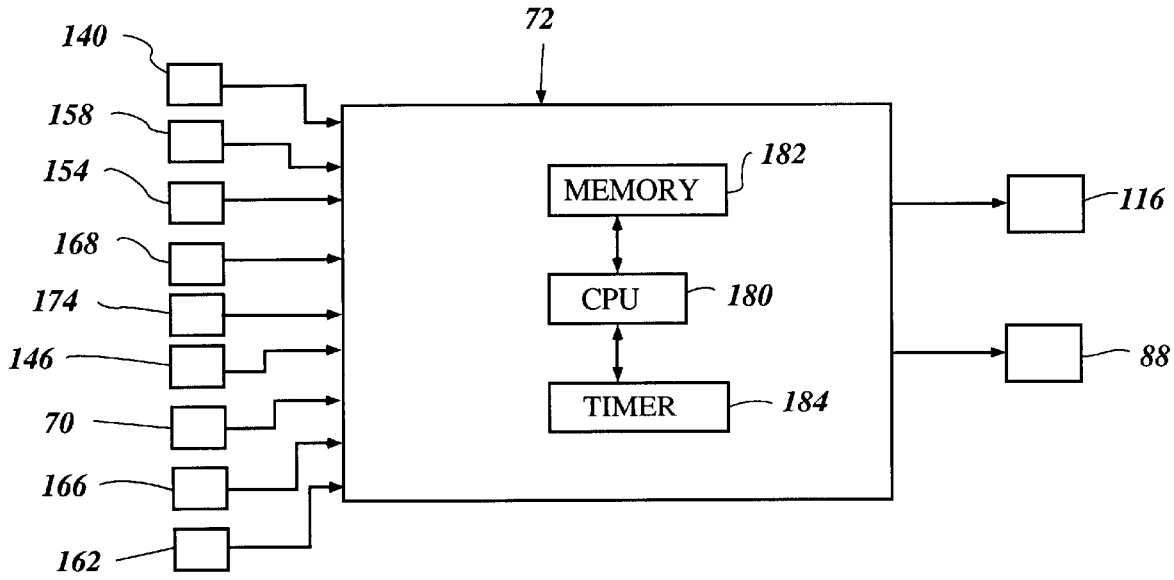
FIG. 3 is a schematic representation of the ECU shown in FIG. 1, receiving input from a number of sensors, and directing output to the sparkplugs and fuel injectors of the engine shown in FIG. 1.

The control for the fuel/air ratio preferably includes a feedback control system. Thus, a combustion condition or oxygen sensor 146 is provided and determines the in-cylinder combustion conditions by sensing the residual amount of oxygen in the combustion products at about a time when the exhaust port 76 is opened. A data line 147 carries this output signal to the ECU 72, as schematically illustrated in FIGS. 1 and 3.

As shown in FIG. 1, an engine speed sensor 148 measures the crank angle and transmits it to the ECU 72, as schematically indicated. In the illustrated embodiment, the engine speed sensor 148 is in the form of a pulsar coil 150 which is configured to emit a single pulse for each revolution of the crankshaft 42. The signal from the engine speed sensor 148 is transmitted to the ECU 72 via an engine speed data line 152. Engine load, which can be determined by a throttle angle of the throttle valves 64, is sensed by the throttle valve position sensor 70 and is transmitted to the ECU 72 via the throttle position data line 74.

A fuel line pressure sensor (not shown) may be provided which communicates with one of the fuel conduits 108, 110. This pressure sensor can output a high pressure fuel signal to the ECU 72. There also may be provided a trim angle sensor 154 (see the lower portion of FIG. 1) which outputs the trim angle of the outboard motor 10 to the ECU 72, via a trim angle data line 156. Further, an intake air temperature sensor (not shown) may be provided which outputs a temperature signal to the ECU 72.

An atmospheric pressure sensor 158 measures the atmospheric pressure of the ambient air and transmits the signal representing the pressure to the ECU 72, via an atmospheric pressure data line 160. There also may be provided a back pressure sensor (not shown) that outputs exhaust back pressure to the ECU 72.

An engine temperature sensor 162 is connected to the engine block 32 to sense temperature of coolant flowing through the water jacket 140. The engine temperature sensor 162 transmits the temperature of the engine, in terms of the temperature of the coolant flowing through the water cooling jacket 140, via an engine temperature data line 164. An oil pressure sensor 166 and an oil temperature sensor 168 are connected to the lubricant supply line 136 so as to sense engine lubricant pressure and temperature, respectively. The lubricant pressure sensor 166 and the lubricant temperature sensor 168 transmit lubricant pressure and temperature data via a lubricant pressure data line 170 and a lubricant temperature data line 172, respectively. Optionally, the outboard motor 10 may include an alarm system configured to emit an alarm when a pressure and/or a temperature in the lubricant supply line 136 reach undesired levels.

Preferably, an intake air pressure sensor assembly 174 is connected to the intake runner 54 so as to sense an air pressure within the air intake passage 56. The pressure detected by the induction air pressure 174 is transmitted to the ECU 72 by an air pressure data line 176.

The sensed conditions disclosed above are merely some of those conditions which may be sensed for under control and it is, of course, practicable to provide other sensors such as, for example, without limitation, an engine height sensor, a knock sensor, a neutral sensor, a watercraft pitch sensor, and an atmospheric temperature sensor in accordance with various control strategies.

The ECU 72 computes and processes the detection signal of each sensor based on a control map. The ECU 72 forwards control signals to the fuel injectors 88, spark plugs 116, the electromagnetic solenoid valve units which operate the fuel injectors 88, and the fuel pumps 94, 106, for their respective control. Respective control lines that are indicated schematically in FIG. 1 carry these control signals.

As noted above, the ECU 72 determines the appropriate duration of fuel injection in order to produce a charge with a desired air fuel ratio. Thus, part of the determination of fuel injection duration is based on the induction air pressure sensed by the induction air pressure sensor assembly 174, which is indicative of the mass flow rate of induction air through the induction passage 56. In order to determine a minimum pressure in the induction system, the ECU 72 samples the output of the induction air pressure sensor assembly 174.

With reference to FIG. 3, the construction of the ECU 72 is described in more detail below. As shown in FIG. 3, the ECU 72 includes a CPU 180, a memory 182, and a timer 184. The CPU 180 receives input from the sensors 70, 140, 154, 158, 162, 166, 168, 174 through corresponding communication lines in order to control various characteristics of engine operation, such as, for example but without limitation, the firing of the spark plugs 116 and timing and duration of fuel injection through the fuel injectors 88. The maps noted above, utilized by the ECU 72 for determining the various parameters regarding engine operation, are stored in the memory 182. The CPU 180 interacts with the timer 184 and the memory 182 to process the information gathered from the sensors 70, 140, 146, 154, 162, 168, 174 and generate output to other components of the outboard motor 10 including spark plugs 116 and the fuel injectors 88. It is apparent to one of ordinary skill in the art that the ECU 72 can alternatively be in the form of a hard-wired feedback control system.

During operation of the outboard motor 10, the ECU 72 samples the output from the induction air pressure sensor assembly 174 in order to determine a minimum air pressure in the induction passage 56. In order to minimize the manufacturing cost and complexity of the ECU 72, the ECU 72 desirably is configured to sample the output from the induction air pressure sensor assembly 174 only once for each rotation of the crankshaft 42.

Figure 4:
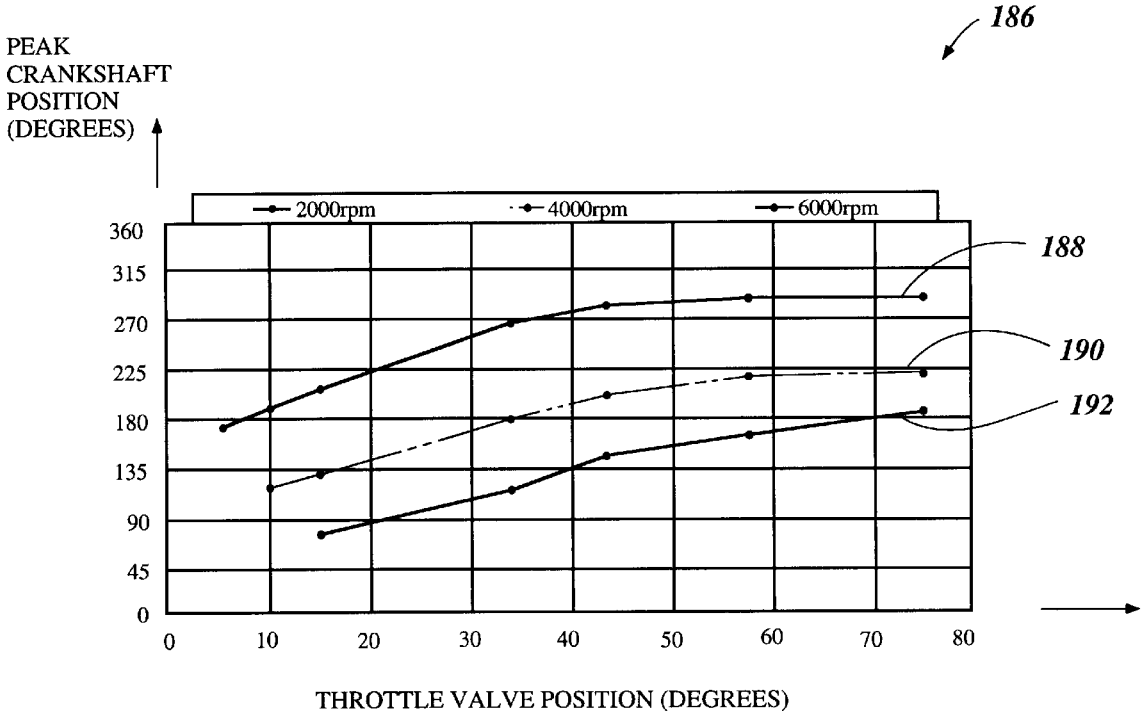
FIG. 4 is a graph representing a map reflecting the relationship between peak positions of the crankshaft included in the engine shown in FIG. 1, along the vertical axis, throttle positions graphed along the horizontal axis, and three curves corresponding to three different engine speeds.

In order to determine the proper timing at which the ECU should sample the induction air pressure sensor assembly 174 so as to coincide with the minimum air pressure generated in the induction passage 56, the memory 182 includes a three-dimensional map 186 illustrated in FIG. 4. The three-dimensional map 186 includes peak crankshaft position plotted on the vertical axis. The peak crankshaft position corresponds to the angular position of the crankshaft 42 at which the minimum pressure is generated within the induction passage 56. The horizontal axis of the map 186 shown in FIG. 4 represents a plurality of values of another engine operation characteristic. In the illustrated embodiment, the horizontal axis represents the angular position of the throttle valve 64 in degrees. Each of the curves 188, 190, 192 illustrates the relationship between throttle valve position and the peak crankshaft position for a particular engine speed. In the illustrated embodiment, the curve 188 represents the relationship between throttle valve position and the peak crankshaft position at an engine speed of 6000 rpm. Similarly, the curve 190 represents this relationship at an engine speed of 4000 rpm and the curve 192 represents this relationship at an engine speed of 2000 rpm.

The data contained in the three-dimensional map 186 shown in FIG. 4 is exemplary of data that can be derived through experimentation for a particular engine. Once the data is determined, it can be stored in a memory of a controller, such as the memory 182 of the ECU 72 (FIG. 3).

As noted above, one aspect of the present invention includes the realization that the peak crankshaft position for an internal combustion engine predictably varies with the throttle valve position for example, as illustrated in FIG. 4, the peak crankshaft position for the engine 30 increases as the throttle valve position is increased.

Figure 5:
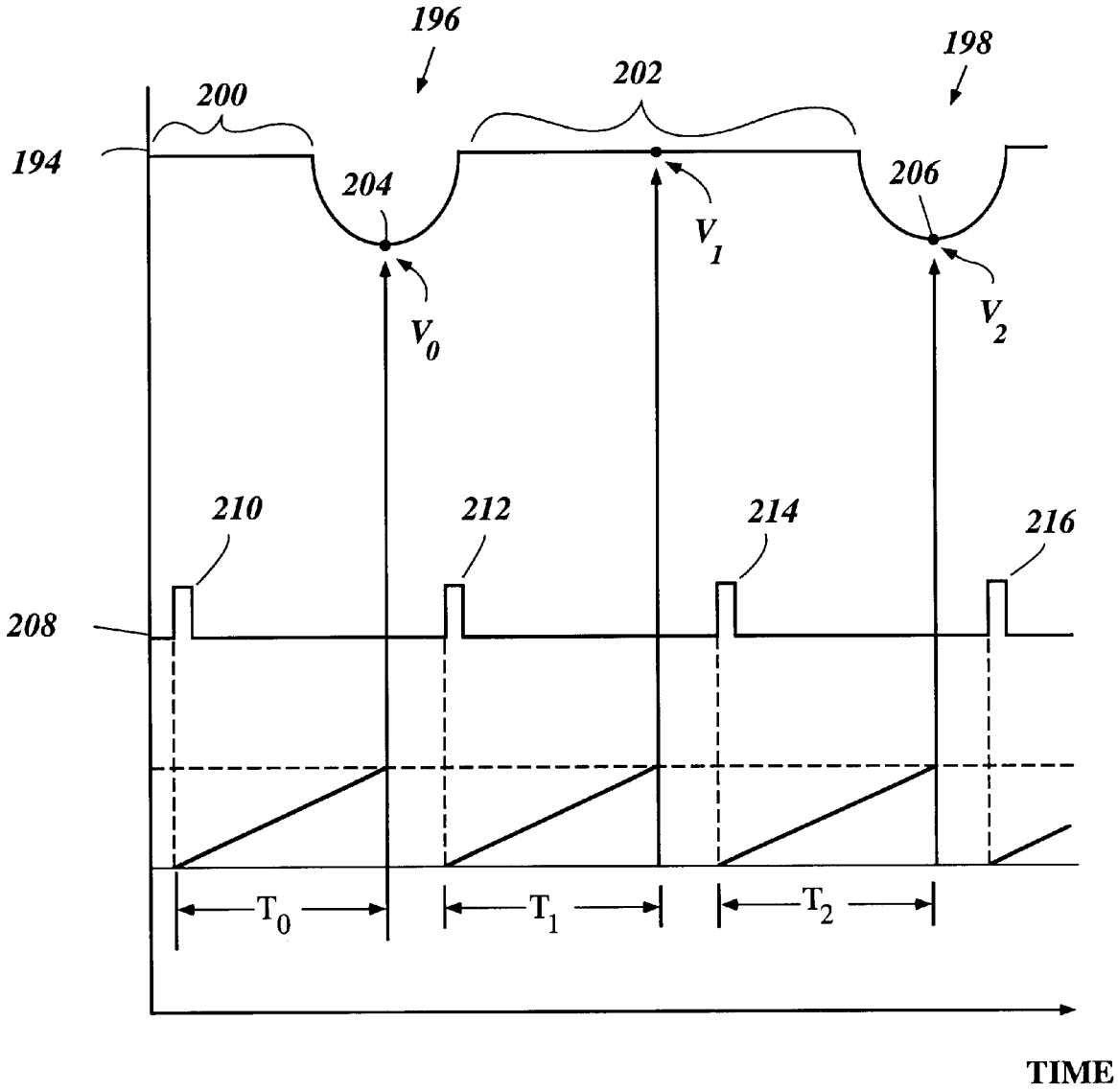
FIG. 5 is a timing diagram illustrating the timing relationship between an output signal of the pressure sensors shown in FIG. 2, an output signal of a speed sensor shown in FIG. 1, and a pressure sensor sampling timing determined by the ECU shown in FIG. 3.

In operation, the ECU 72 refers to the data contained in the three-dimensional map 186 in order to determine the appropriate timing for sampling the induction air pressure sensor assembly 174. For example, the ECU 72 receives a fluctuating analog or digital signal from the induction air pressure sensor assembly 174. An exemplary output voltage signal 194 of the air pressure sensor assembly 174 is illustrated in FIG. 5. With respect to the output signal 194, voltage is plotted on the vertical axis and time is plotted along the horizontal axis. As shown in FIG. 5, the voltage output signal 194 of the induction air pressure sensor assembly 174 fluctuates over time. Fluctuations, indicated generally by the reference numerals 196, 198 in the signal 194, correspond to pressure fluctuations in the induction passage 56 (FIG. 1).

During operation of the engine 30, the piston 36 reciprocates within the cylinder bore 34 and the induction valve 60 opens and closes according to the rotation of the intake camshaft 82. During an intake stroke of the piston 36, the piston 36 moves downwardly, as viewed in FIG. 1, within the cylinder bore 34. During at least a portion of the downward movement of the piston 36 within the cylinder bore 34, the intake camshaft 82 causes the intake valve 60 to open, thus allowing the downward movement of the piston 36 to draw air into the combustion chamber 40 through the intake passage 56. As the piston 36 moves downwardly, a partial vacuum is created in the intake passage 56, thus causing the pressure in the intake passage 56 to fall. Accordingly, the output voltage of the induction air pressure sensor assembly 174, illustrated as signal 194, also falls. When the induction air within the induction passage 56 stops, the air pressure therein returns roughly to atmospheric pressure, thus causing the output voltage of the induction air pressure sensor to return to the voltage corresponding to approximately atmospheric pressure.

As shown in FIG. 5, the output voltage signal 194 of the induction air pressure sensor assembly 174 is approximately constant over time periods designated by the reference numerals 200, 202, which correspond to the period of time when the induction air in the vicinity of the induction air pressure sensor assembly 174 is stationary. However, it is to be noted that the output signal 194 may fluctuate to a greater extent than that illustrated in the time periods 200, 202, discussed in more detail below. The fluctuations 196, 198 in the voltage signal 194 correspond to time periods during which the air in the vicinity of the induction air pressure sensor assembly 174 moves. As shown in FIG. 5, the voltage signal 194 reaches minimum values 204, 206, respectively. The minimum values 204, 206 correspond to minimum absolute air pressures in the vicinity of the induction air pressure sensor assembly 174.

Figure 6:
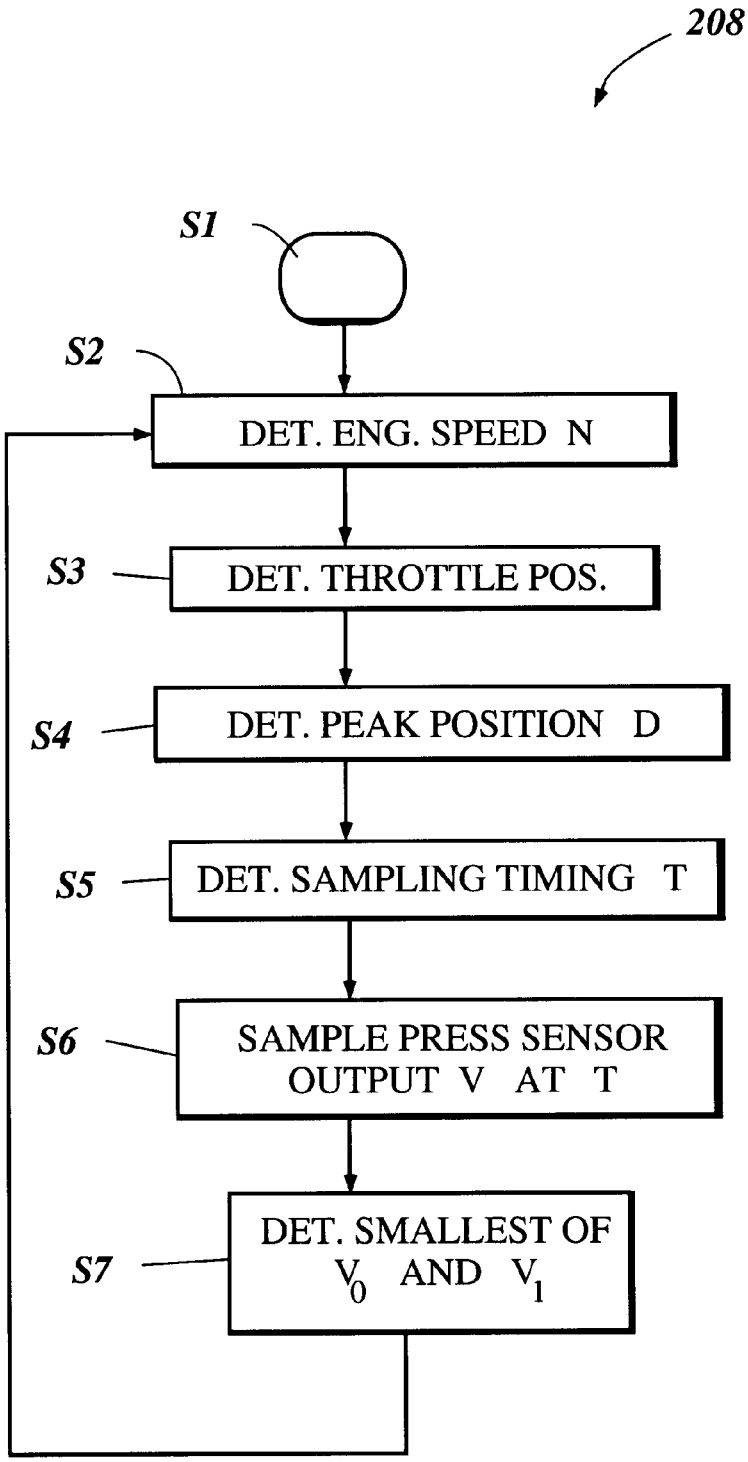
FIG. 6 is a flow diagram of a pressure sensor sampling control subroutine.

With reference to FIG. 6, a control subroutine 208 for sampling the output signal of the induction air pressure sensor assembly 174 is illustrated. The control subroutine 208 can begin at a step S1, when the engine 30 is running and/or when electrical power is first provided to the ECU 72. After the control subroutine 208 has been initiated, the program moves on to a step S2.

At the step S2, the ECU 72 determines the engine speed N. For example, the ECU 72 may receive a signal from the engine speed sensor 148, or from a translator (not shown) which translates the signal from the engine speed sensor 148 into another signal for further processing by the ECU 72. For example, the engine speed N can be determined by counting a number of engine revolutions and averaging the number of revolutions over a time to determine the engine speed in terms of revolutions per minute. After the ECU 72 has determined the engine speed N, subroutine 208 moves on to a step S3.

At the step S3, the ECU 72 determines the throttle position. For example, the ECU 72 can sample the voltage output signal from the throttle position sensor 70, in order to determine the angle of the throttle position. After the throttle position has been determined, the control subroutine 208 moves onto a step S4.

At the step S4, the peak position of the crankshaft D is determined. As noted above, the peak position of the crankshaft is the position of the crankshaft when the air pressure in the induction passage 56 in the vicinity of the induction air pressure sensor assembly 174 reaches a minimum value. This information is predetermined and stored in a three-dimensional map, such as the three-dimensional map 186 illustrated in FIG. 4. In the illustrated embodiment, in order to determine the peak position of the crankshaft D, the ECU 72 identifies the peak crankshaft position according to the engine speed N in step S2 and the throttle position determined in the step S3. Preferably, the peak position D is in units of degrees. After the peak crankshaft position D has been determined, the control routine 208 moves on to a step S5.

At the step S5, a sampling timing T is determined. The sampling timing T, which is expressed as seconds in the illustrated embodiment, corresponds to the time required for the crankshaft to reach the peak position D from the generation of a pulse signal from the engine speed sensor 148. In the illustrated embodiment, the engine speed sensor 148 outputs a signal when the crankshaft 42 reaches zero degrees. Thus, the sampling timing is calculated as follows:

$$T=D\times 60\div(360\times N),$$

where N is the engine speed and revolutions per minute, D is peak crankshaft position in degrees, and T is the desired sampling timing in seconds. After the sampling timing T has been determined, the subroutine 208 moves onto a step S6.

At the step S6, the output of the induction air pressure sensor assembly 174 is sampled at the sampling timing T. In the illustrated embodiment, the timer 184 clocks the time from a pulse signal from the engine speed sensor 148 until the sampling timing T has elapsed. Once the sampling timing T has elapsed, the ECU 72 samples the output voltage V of the induction air pressure sensor assembly 174. With reference to FIGS. 3 and 5, the ECU 72 can sample the voltage output directly via the dataline 176. During continuous operation, the ECU 72 will sample the output signal 194 a number of times generating a plurality of readings, e.g., $V_0$, $V_1$, $V_2$, as illustrated in FIG. 5.

At the step S7, the voltage sampled at step S6, e.g., $V_1$, is compared to a previously sampled voltage $V_0$ which was sampled in a previous cycle of the subroutine 208. The smallest of the voltages $V_0$, $V_1$ is determined as the minimum induction air pressure signal, and is thus used by the ECU 72 to further determine fuel injection duration. After the step S7, subroutine 208 returns to the step S2 and repeats. In this manner, the ECU 72 can determine a minimum air pressure within the induction passage 56 and thus estimate a volume of air passing in the combustion chamber 40.

With reference to FIG. 5, timing of the sampling performed during the routine 208 will now be described in further detail. As shown in FIG. 5, the sampling timing $T_0$, $T_1$, $T_2$ is determined in the step S5 (FIG. 6) and is indicated in the lower portion of the graph illustrated therein. Additionally, an output signal 208 of the engine speed sensor 148 is illustrated below the output voltage signal 194. The output signal 208 of the engine speed sensor 148 is in the form of pulses, one pulse 210, 212, 214, 216, for each rotation of the crankshaft 42. As noted above, with reference to the step S5, the sampling timing T is determined as a function of the peak crankshaft position D determined in the step S4 and the engine speed N determined in the step S2. As noted above, the sampling timing T is in units of time, i.e., seconds, to be measured from the detection of an output pulse 210, 212, 214, 216, from the engine speed sensor 148. Thus, each output pulse 210, 212, 214, 216 illustrated in FIG. 5 corresponds to a time at which the crankshaft 42 rotates past zero degrees or "top dead center."

As shown in FIG. 5, when the output pulse 210 is received by the ECU 72, the timer 184 (FIG. 3) begins. In the illustrated embodiment, the timer 184 is in the form of a counter which begins counting when the pulse 210 is received by the ECU 72. When the counter reaches the value corresponding to the sampling timing $T_0$, the ECU 72 samples the voltage $V_0$ directly from the induction air pressure sensor assembly 174 via the dataline 176. By sampling the voltage V at the timing T, the ECU 72 can accurately sample the output signal 194 of the induction pressure sensor assembly 174 at the time at which the signal 194 reaches the minimum point 204, 206.

As noted above, the engine 30 is a four-cycle type engine. Thus, the induction valve 60 opens only once for every two revolutions of the crankshaft 42. Thus, there is only one fluctuation 196, 198 in the voltage signal 194 for every two revolutions of the crankshaft 42, and thus, for every two pulses of the output signal 194 of the engine speed sensor 148. When the output signal 194 is sampled after the sampling timing T1 has elapsed, as illustrated in FIG. 5, yielding the voltage $V_1$, the sampled voltage $V_1$ is compared to the voltage $V_0$ sampled at the end of the previous sampling timing $T_0$. In the illustrated example, the voltage $V_0$ is smaller than the voltage $V_1$. Thus the voltage $V_0$ is determined as the voltage corresponding to the minimum air pressure in the induction air passage 56, and is further used by the ECU 72 to determine the proper fuel injection duration period.

Figure 7:
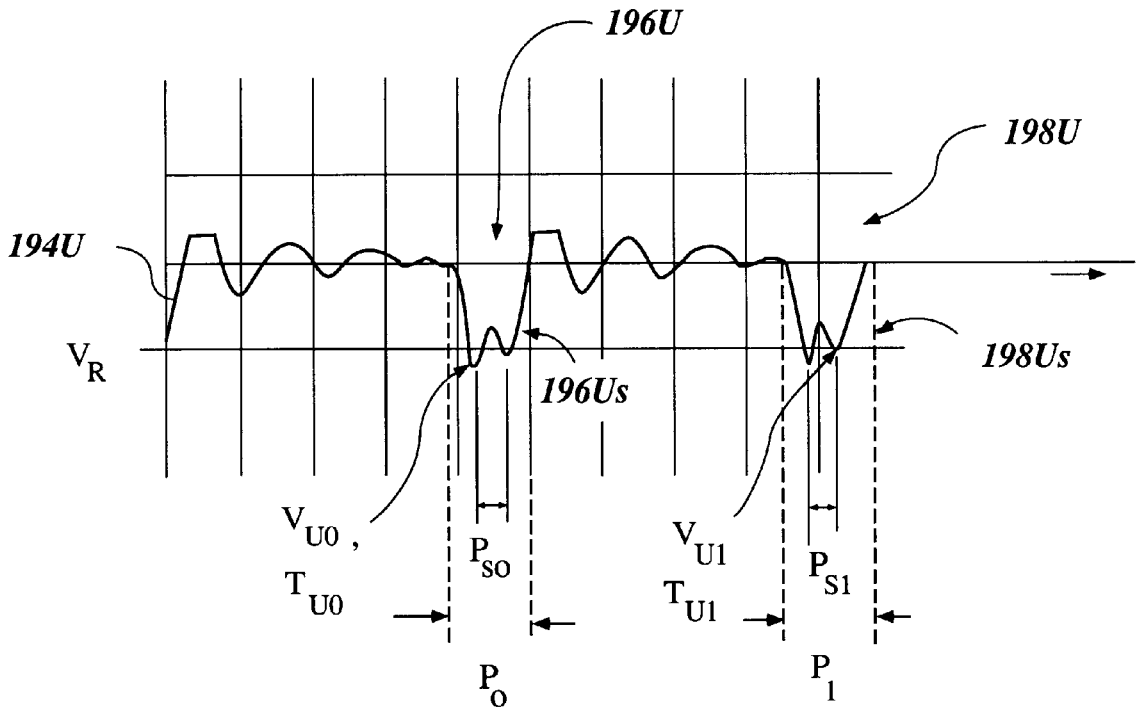
FIG. 7 is a graph having pressure sensor output signal magnitude of a pressure sensor without a smoothing system plotted on the vertical axis and time plotted on the horizontal axis.

As noted above, one aspect of the present invention includes the realization that the output voltage signal of an induction air pressure sensor, such as the induction air pressure 174, further fluctuates unpredictably during operation of the engine 30. For example, with reference to FIG. 7, an illustrative example of an output signal 194U is illustrated therein. As shown in FIG. 7, the signal 194U includes varying fluctuations over time. Of particular significance is the area corresponding to the minimum air pressure of the fluctuations 196U, 198U. As shown in FIG. 7, a sub-fluctuation 196$U_S$ in the signal 194U occurs within the fluctuation 196U and reaches a minimum voltage of $V_{U0}$. Similarly, a sub-fluctuation 198$U_s$ within the fluctuation 198U reaches a minimum voltage of $V_{U1}$.

One aspect of the present invention includes a realization that these sub-fluctuations 196$U_S$, 198$U_S$, a representative example being illustrated in FIG. 7, are caused at least in part by a flow condition within the induction system. In particular, a flow condition of an air flow in the vicinity of the air pressure sensor assembly 174 is at least partially responsible for the sub-fluctuations 196$U_S$, 198$U_S$ described above with reference to FIG. 7. For example, with reference to FIG. 9, an enlarged sectional view of the air pressure sensor assembly 174 is illustrated therein.

Figure 9:
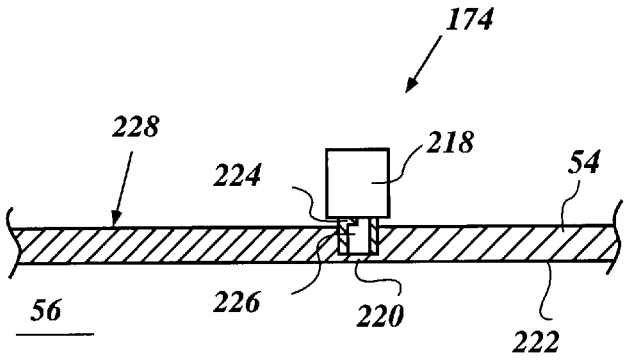
FIG. 9 is an enlarged sectional view of the pressure sensor assembly communicating with the induction system of the engine illustrated in FIG. 1.

As shown in FIG. 9, the pressure sensor assembly 174 includes an air pressure sensor 218 which communicates with an aperture 220 formed on an inner surface 222 of the intake runner 54. The pressure sensor assembly 174 includes an air pressure inlet port 224 which communicates with the aperture 220 via a fluid communication conduit 226. As is apparent from FIG. 9, the fluid communication conduit 226 is relatively short.

In this embodiment, the air pressure inlet port 224 is approximately coplanar with an outer surface 228 of the intake runner 54. It has been found that where the air pressure inlet port 224 of the pressure sensor assembly 174 communicates with an air flow within an intake runner, such as the intake runner 54, through a short fluid communication conduit, e.g., fluid communication conduit 226, a condition of the flow in the vicinity of the aperture 220 causes fluctuations, such as the sub-fluctuations 196$U_{S,\ 198US}$, illustrated in FIG. 7. These fluctuations have been found to impair the accuracy of the determination of the minimum air pressure within the intake runner 54.

Figure 10:
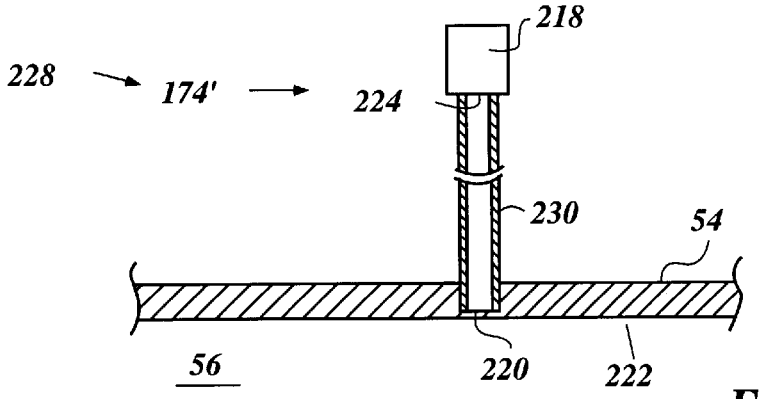
FIG. 10 is a sectional view of a smoothing system constructed in accordance with an embodiment of the present invention, incorporated into the pressure sensor assembly illustrated in FIG. 9.
Figure 11:
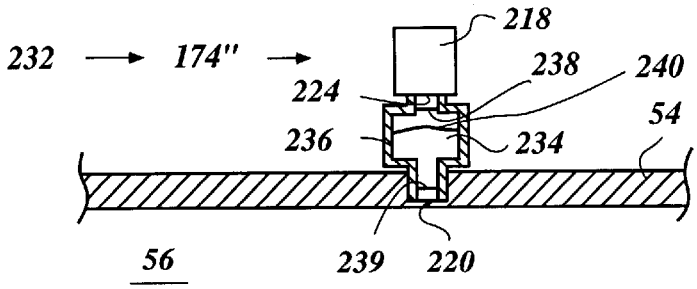
FIG. 11 illustrates a modification of smoothing system illustrated in FIG. 10.
Figure 12:
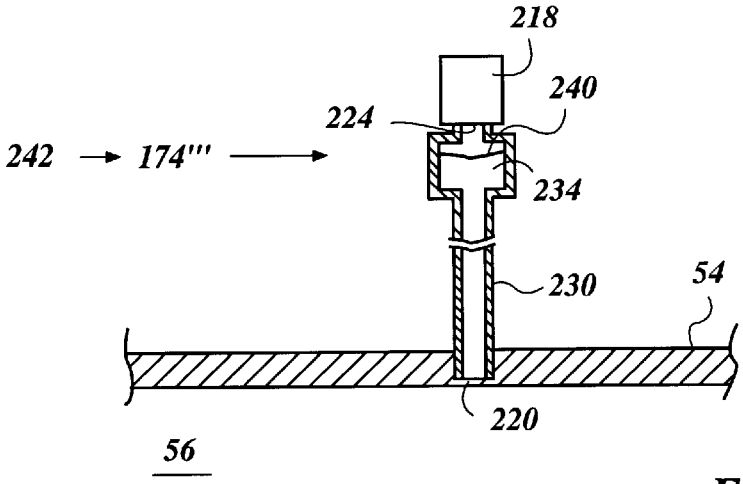
FIG. 12 is a further modification of the smoothing system illustrated in FIG. 10.

In accordance with another aspect of the present invention, as shown in FIGS. 10–12, the engine 30 can include a smoothing system that is configured to smooth a flow of air in the vicinity of the air pressure sensor assembly 174. For example, as shown in FIG. 10, the smoothing system 228 is incorporated into an air pressure assembly 174' which includes the pressure sensor 218 having an air pressure inlet port 224 which communicates with the aperture 220 formed in the inner surface 222 of the intake runner 54. The air pressure inlet port 224 communicates with the aperture 220 via an elongated hose 228.

It has been found that by providing an elongated hose, such as the elongated hose 230 illustrated in FIG. 10, for connecting air pressure inlet of an air pressure sensor with an aperture formed in an induction system, sub-fluctuations, such as those illustrated in FIG. 7, can be attenuated.

Figure 8:
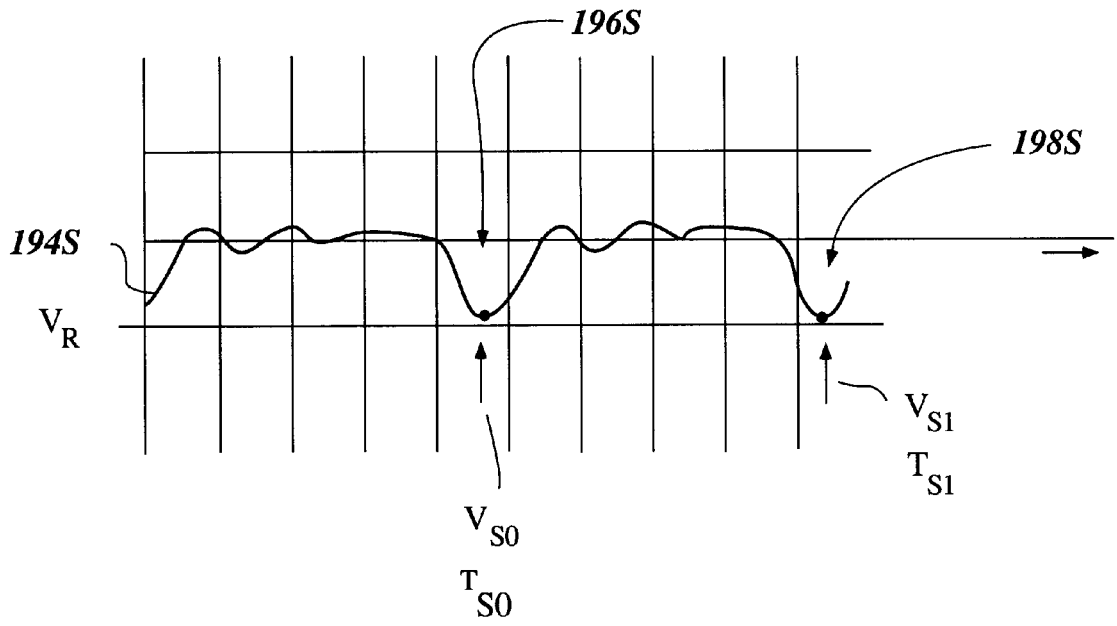
FIG. 8 is a graph illustrating pressure sensor output signal magnitude on the vertical axis and time on the horizontal axis, illustrating the output of the pressure sensor having a smoothing system.

For example, with reference to FIG. 8, an output signal 194S of the air pressure sensor assembly 174' is illustrated therein. As shown in FIG. 8, the smoothed output signal 194S includes fluctuations 196S and 198S which are generated by the movement of air within the induction passage 56 and which generally correspond to the fluctuations 196U, 198U, respectively, illustrated in FIG. 7. However, as is apparent from FIG. 8, the sub-fluctuations 196$U_S$, 198$U_S$, illustrated in FIG. 7 are not present in the signal 194S illustrated in FIG. 8. Rather, the smoothing system 228 illustrated in FIG. 10 has smoothed the air flow in the vicinity of the pressure sensor 218 and thus has smoothed the output signal of the air pressure assembly 174'.

It should be noted that the smoothing system 228 has caused two differences between the signal 194U and the signal 194S.

Firstly, a reference voltage $V_R$ is labeled on the graphs of FIGS. 7 and 8. As shown in FIG. 7, a minimum voltage $V_{U0}$ is less than the reference voltage $V_R$. In contrast, as shown in FIG. 8, the minimum voltage $V_{S0}$ is greater than the reference voltage $V_R$. Thus, by smoothing the output signal of the pressure sensor 218 with the smoothing assembly 228, the resulting smoothed output signal 194S provides a more stable and accurate reflection of the air flow in the induction passage 56 which provides the ECU 72 with a more stable and accurate source of input data regarding air flow. As such, the ECU 72 can more reliably and accurately control fuel injection.

Secondly, as shown in FIG. 7, the minimum voltage $V_{U0}$ occurs at a time $T_{U0}$. However, as shown in FIG. 8, the minimum voltage $V_{S0}$ occurs at a time $T_{S0}$. As illustrated in FIGS. 7 and 8, the time $T_{U0}$ is different from the time $T_{S0}$. Additionally, it can be seen that by comparing FIGS. 7 and 5, the smooth signal 194S more closely reflects the more schematic or theoretical representation of the output signal 194. Thus, by including a smoothing system, such as the smoothing system 228 which generates a smoothed signal such as the signal 194S, sampling of the signal 194S in accordance with the timing calculated from the map 186 is more accurate. It should be noted that one of ordinary skill in the art can determine through routine experimentation the appropriate length of the hose 230 for providing the desired attenuation.

Another difference between the exemplary unsmoothed output signal 194U and the smoothed signal 194S is that the sub-fluctuations 196$U_S$, 198$U_S$ have a higher frequency than the fluctuations 196U, 198U, respectively. For example, the sub-fluctuation 196$U_S$ occurs within a time period $P_{S0}$, and the corresponding fluctuation 196U occurs over a time period $P_0$. Thus the frequency $f_S$ can be expressed as the inverse of the time period $P_{S0}$, i.e., $$\frac{1}{P_{S0}}.$$

Similarly, the frequency f of the fluctuation 196U can be expressed as the inverse of the time period $P_0$, i.e., $$\frac{1}{P_0}.$$

Thus, since the time period $P_{S0}$ of the sub-fluctuation 196$U_S$ is less than the time period $P_0$ of the fluctuation 196U, the frequency of $f_S$ of this sub-fluctuation 196$U_S$ is higher than the frequency f of the fluctuation 196U. Thus, the length of the hose 230 can be sized so as to attenuate fluctuations in the output signal 194U of the pressure sensor 218 that occur at a frequency higher than that corresponding to the time period of the fluctuations, such as fluctuations 196U, 198U, that are generated by the movement of air through the induction passage 56 as a result of the opening and closing of the intake valve 60.

FIG. 11 illustrates a modification of the smoothing system 228 illustrated in FIG. 10. As shown in FIG. 11, the smoothing system 232 includes a pressure sensor assembly 174" which includes the pressure sensor 218 communicating with the aperture 220. In this modification, the smoothing system 232 includes an intermediate chamber 234 disposed between the air pressure intake 224 and the aperture 220. In the illustrated modification, the intermediate chamber 234 is formed integrally with a fluid conduit member 236 which extends between the aperture 220 and the air pressure intake 224. However, it is conceived that the intermediate chamber 234 could be connected to the air pressure intake 224 and the aperture 220 with further intermediate conduits or hoses (not shown).

By including the intermediate chamber 234 in the smoothing system 232, an air flow in the vicinity of the pressure sensor 218 can be smoothed so as to provide results consistent with the description set forth above with reference to the smoothing system 228 illustrated in FIG. 10. In this modification, the size of the intermediate chambers 234 can be configured to provide the desired attenuation of subfluctuations, such as the subfluctuations 196$U_S$, 198$U_S$. In this mode, a cross-sectional area 238 of the air pressure inlet 224 is less than cross-sectional area 240 of the intermediate chamber 234. Alternatively, or in addition, the cross-sectional area 240 is larger than the cross-sectional area 239 of the end of the conduit member 236. By adjusting the relative size of the cross-sectional areas 238, 240, attenuation of the subfluctuations corresponding to the subfluctuations 196$U_S$, 198$U_S$ can be attenuated as desired.

FIG. 12 illustrates a further modification of the smoothing system 228 illustrated in FIG. 10. As shown in FIG. 12, a smoothing system 242 includes a pressure sensor assembly 174'". In this mode, the pressure sensor assembly 174'" includes the pressure sensor 218 communicating with the aperture 220. In this mode, the air pressure inlet 224 communicates with the aperture 220 via an intermediate chamber 234 and an elongated hose 230. Thus, the smoothing system 242 incorporates the elongated hose 230 in the intermediate chamber 234 of the smoothing systems 228, 232, respectively. In this mode, the length of the elongated hose 230 and the cross-sectional area 240 of the intermediate chamber 234 relative to the cross-sectional area of the air pressure inlet 224 can be adjusted to provide the desired attenuation. By adjusting these features as such, attenuation of the air flow in the vicinity of the air pressure inlet 224 is consistent with the description set forth above with respect to the smoothing system 228.

Figure 13:
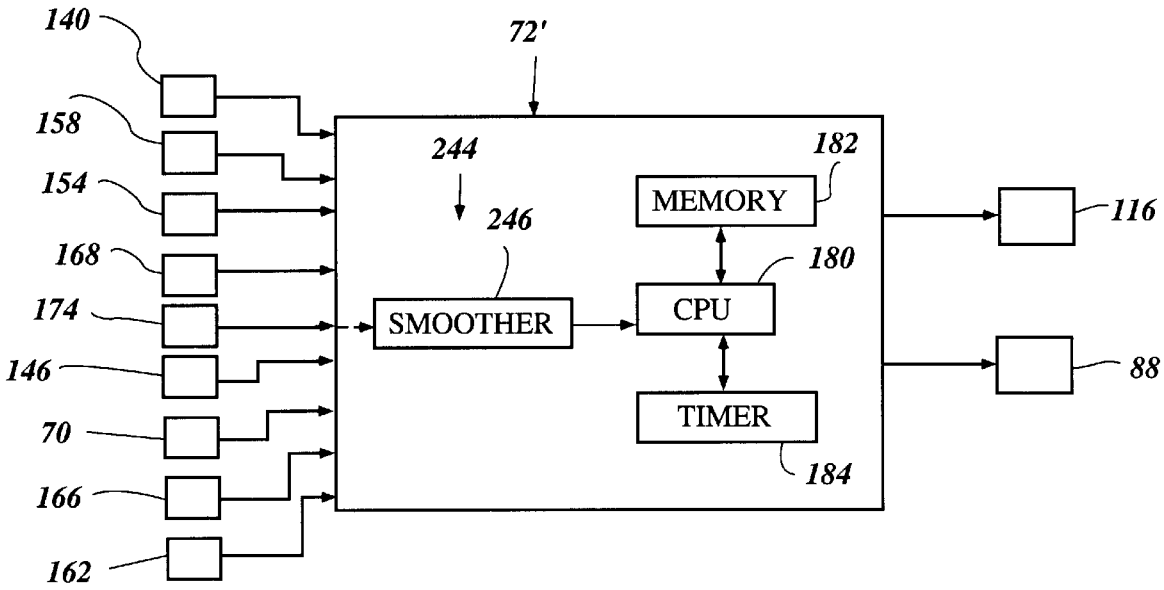
FIG. 13 is a schematic representation of a modification of the ECU illustrated in FIG. 3 having a smoothing device included therein.
Figure 14:
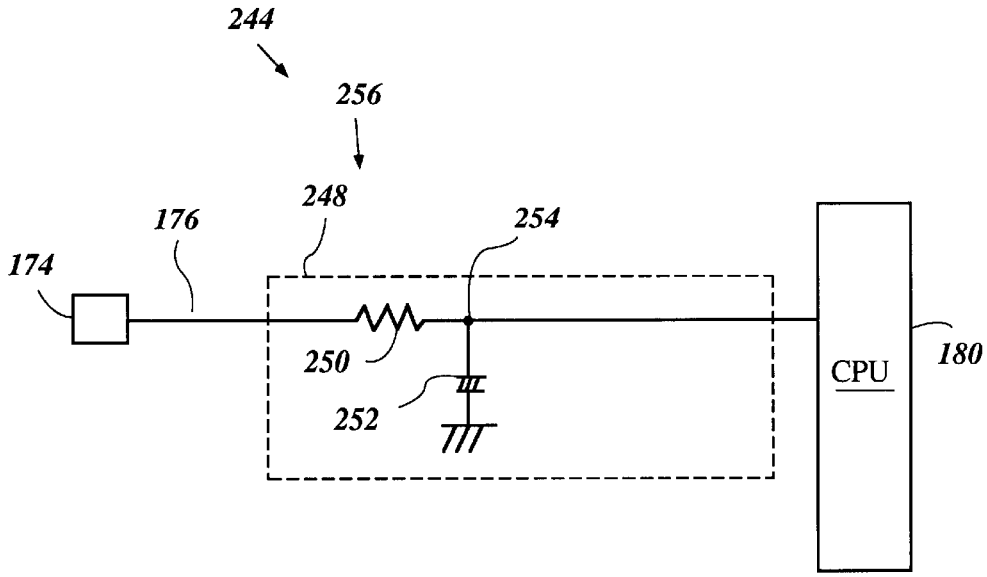
FIG. 14 is a schematic representation of a smoothing circuit.

With reference to FIGS. 13 and 14, further modification of the smoothing system 228 is illustrated therein. As shown in FIG. 13, a smoothing system 244 is incorporated into an ECU 72'. The ECU 72' can be constructed in accordance with the description set forth above with reference to FIG. 3 and the ECU 72, except as noted below. The smoothing system 244 includes a smoothing device 246 that is configured to attenuate fluctuations in the signal from the pressure sensor assembly 174.

With reference to FIG. 14, in one embodiment, the smoother device 246 is in the form of the smoothing circuit 248. In this embodiment, the smoothing circuit 248 includes a resistor 250 and the capacitor 252. The data line 176 leading from the pressure sensor assembly 174 is connected to the resistor 250. The resistor 250 is also connected to a node 254 which is also connected to the CPU 180. The node 254 is also connected to the positive side of the capacitor 252 with a negative side of the capacitor 252 being grounded. As such, the smoothing circuit 248 acts as a smoother for an analog signal received from. the data line 176. The resistance of the resistor 250 and the capacitance, of the capacitor 252 can be adjusted to smooth or attenuate particular frequencies, as is known in the art. Thus, one of ordinary skill in the art can choose the resistance of the resistor 250 and the capacitance of the capacitor 252 to attenuate a desired range of frequencies.

For example, as noted above, the frequency of the sub-fluctuations 196$U_S$, 198$U_S$ occur at a frequency higher than the frequency corresponding to the period $P_0$, $P_1$ of the fluctuations 196U, 198U, respectively. Thus, the resistance of the resistor 250 and the capacitance of the capacitor 252 can be chosen so as to attenuate fluctuations occurring at a frequency higher than that of the frequency corresponding to the fluctuations in the air pressure within the induction passage 56 generated by the movement of the piston 36 and the opening and closing of the intake valve 60. As such, the smoothing circuit 148 can provide results in accordance with the description of the results set forth above with reference to the smoothing system 228 illustrated in FIG. 10.

Alternatively, the smoother device 246 can be constructed as a digital filter configured to attenuate certain predetermined frequencies.

Of course, the foregoing description is that of certain features, aspects and advantages of the present invention to which various changes and modifications may be made without departing from the spirit and scope of the present invention. Moreover, an outboard motor may not feature all objects and advantages discussed above to use certain features, aspects and advantages of the present invention. Thus, for example, those skilled in the art will recognize that the invention may be embodied or carried out in the manner that achieves or optimizes one advantage or a group of advantages as taught herein without necessarily achieving other objects or advantages as may be taught or suggested herein. The present invention, therefore, should only be defined by the appended claims.

What is claimed is:

1. An engine comprising an engine body defining at least one cylinder bore and at least one piston which together define at least one combustion chamber therein, a crankshaft rotatably journaled at least partially within the engine body, an induction system configured to guide induction air into the combustion chamber, a pressure sensor assembly configured to detect a pressure of an air flow in the induction system and to output a pressure signal indicative of the pressure detected, a charge former configured to supply a fuel charge for combustion in the combustion chamber, a controller configured to control the charge former as a function of at least the pressure signal, and a smoother system configured to smooth at least one of the pressure signal and the air flow in the induction system in the vicinity of the pressure sensor assembly, so as to preserve a pressure signal fluctuation corresponding to movement of the piston during an intake stroke.

2. The engine according to claim 1, wherein the smoother system comprises an extension member extending between an aperture formed in the induction system and the pressure sensor.

3. The engine according to claim 1, wherein the extension member comprises a hose.

4. The engine according to claim 1, wherein the smoother system comprises a smoothing circuit configured to smooth the output signal of the air pressure sensor.

5. The engine according to claim 1, wherein the smoother system comprises an electronic smoothing device configured to smooth the output of the signal of the air pressure sensor.

6. The engine according to claim 1, wherein the smoother system is configured to smooth the output of the air pressure sensor so as to attenuate fluctuations in the air pressure sensor output signal that are in the frequency of higher than ½ of a rotational speed of the crankshaft.

7. The engine according to claim 1 additionally comprising an intake valve controlling a flow of air from the induction system to the combustion chamber, wherein the smoother system is configured to smooth the output of the air pressure sensor so as to attenuate fluctuations in a frequency higher than that corresponding to a period during which the intake valve is open.

8. The engine according to claim 1 additionally comprising an engine speed sensor configured to detect rotation of the crankshaft.

9. The engine according to claim 1, wherein the controller is configured to sample the output from the pressure sensor only once per rotation of the crankshaft.

10. An engine comprising an engine body defining at least one combustion chamber therein, a crankshaft rotatably journaled at least partially within the engine body, an induction system configured to guide induction air into the combustion chamber, a pressure sensor assembly configured to detect a pressure of an air flow in the induction system and to output a pressure signal indicative of the pressure detected, a charge former configured to supply a fuel charge for combustion in the combustion chamber, a controller configured to control the charge former as a function of at least the pressure signal, and a smoother system configured to smooth at least one of the pressure signal and the air flow in the induction system in the vicinity of the pressure sensor assembly, wherein the pressure sensor communicates with an aperture in the induction system via a fluid communication conduit, additionally comprising an intermediate chamber disposed along the fluid communication conduit, the intermediate chamber having a cross-sectional area larger than a cross-sectional area of the aperture.

11. The engine according to claim 10, wherein a cross sectional area of the intermediate chamber is larger than a cross sectional area of an inlet to the pressure sensor.

12. An engine comprising an engine body defining at least one combustion chamber therein, a crankshaft rotatably journaled at least partially within the engine body, an induction system configured to guide induction air into the combustion chamber, a pressure sensor assembly configured to detect a pressure of an air flow in the induction system and to output a pressure signal indicative of the pressure detected, a charge former configured to supply a fuel charge for combustion in the combustion chamber, a controller configured to control the charge former as a function of at least the pressure signal, and a smoother system configured to smooth at least one of the pressure signal and the air flow in the induction system in the vicinity of the pressure sensor assembly, and a memory containing data regarding a relationship between a plurality of peak positions of the crankshaft, a plurality of engine speeds, and a plurality of values of an engine operation characteristic other than engine speed.

13. The engine according to claim 12, wherein the peak positions correspond to a position of the crankshaft when an air pressure in the induction system is at a substantially minimum value.

14. The engine according to claim 12 additionally comprising a throttle valve controlling a flow of air through the induction system and a throttle valve position sensor configured to sense a position of the throttle valve and to output a signal indicative of the position detected, and wherein the engine operation characteristic is the position of the throttle valve.

15. The engine according to claim 12 additionally comprising a second memory location, wherein the controller is configured to write an engine speed detected by the engine speed sensor and a corresponding peak crankshaft position to the second memory.

16. The engine according to claim 15, wherein the controller is configured to write the engine speed and the peak crankshaft position to the second memory for each rotation of the crankshaft.

17. The engine according to claim 15 additionally comprising a throttle valve controlling a flow of air through the induction system, a throttle valve position sensor configured to detect a position of the throttle valve and to output a signal indicative of the position dectector, wherein the throttle valve position is the engine operation characteristic, the controller being configured to determine the peak crankshaft position from the second memory if the output of the throttle valve position sensor is substantially zero.

18. An engine comprising an engine body defining at least one combustion chamber therein, a crankshaft rotatably journaled at least partially within the engine body, an induction system configured to guide induction air into the combustion chamber, a pressure sensor assembly configured to detect a pressure of an air flow in the induction system and to output a pressure signal indicative of the pressure detected, a charge former configured to supply a fuel charge for combustion in the combustion chamber, a controller configured to control the charge former as a function of at least the pressure signal, and a smoother system configured to smooth at least one of the pressure signal and the air flow in the induction system in the vicinity of the pressure sensor assembly, wherein the controller is configured to sample the pressure signal only when the crankshaft is approximately at a peak position.

19. An engine comprising an engine body defining at least one combustion chamber therein, a crankshaft rotatably journaled at least partially within the engine body, an induction system configured to guide induction air into the combustion chamber, a pressure sensor assembly configured to detect a pressure of an air flow in the induction system and to output a pressure signal indicative of the pressure detected, a charge former configured to supply a fuel charge for combustion in the combustion chamber, a controller configured to control the charge former as a function of at least the pressure signal, and a smoother system configured to smooth at least one of the pressure signal and the air flow in the induction system in the vicinity of the pressure sensor assembly, wherein the controller is configured such that if a first pressure detected by the pressure sensor is less than a previous pressure detected by the pressure sensor, the controller uses the first pressure as a regular peak value of the induction air pressure.

20. An engine comprising an engine body defining at least one combustion chamber therein, a crankshaft rotatably journaled at least partially within the engine body, an induction system configured to guide induction air into the combustion chamber, a pressure sensor assembly configured to detect a pressure of an air flow in the induction system and to output a pressure signal indicative of the pressure detected, a charge former configured to supply a fuel charge for combustion in the combustion chamber, a controller configured to control the charge former as a function of at least the pressure signal, and a smoother system configured to smooth at least one of the pressure signal and the air flow in the induction system in the vicinity of the pressure sensor assembly, and at least one valve controlling a fluid flow through the combustion chamber and at least one cam shaft actuating the valves, wherein the controller is configured to determine a rotational position of the cam shaft by comparing a first pressure data received from the pressure sensor with a previous pressure data received from the pressure sensor.

21. A engine comprising an engine body defining at least one combustion chamber therein, a crankshaft rotatably journaled at least partially within the engine body, an induction system configured to guide induction air into the combustion chamber, a pressure sensor configured to detect a pressure in the induction system and to output a pressure signal indicative of the pressure detected, a charge former configured to supply a fuel charge to the combustion chamber, a controller configured to control the charge former as a function of at least the pressure signal, and means for smoothing a value of a pressure in the vicinity of the pressure sensor, while preserving the pressure signal fluctuation corresponding to movement of the piston during an intake stroke.

22. A method for controlling the operation of an engine having engine body, at least one combustion chamber defined in the body, a crankshaft journaled for rotation at least partially within the engine body, an induction system configured to guide induction air into the combustion chamber, an induction air pressure sensor configured to detect a pressure in the induction system and generate a pressure signal indicative of the pressure in the induction system, and a charge former configured to deliver fuel charges for combustion in the combustion chamber, the method comprising smoothing the pressure signal while preserving the pressure fluctuation corresponding to movement of the piston during an intake stroke, sampling the smoothed signal, and controlling the operation of the charge former based on at least the smoothed signal.

23. The method according to claim 22 additionally comprising determining a rotational speed of the crankshaft.

24. The method according to claim 23 additionally comprising determining a value of an engine operation characteristic other than engine speed.

25. The method according to claim 22, wherein determining a value of the engine operation characteristic comprises determining a position of a throttle valve which controls a flow of air through the induction system.

26. A method for controlling the operation of an engine having engine body, at least one combustion chamber defined in the body, a crankshaft journaled for rotation at least partially within the engine body, an induction system configured to guide induction air into the combustion chamber, an induction air pressure sensor configured to detect a pressure in the induction system and generate a pressure signal indicative of the pressure in the induction system, and a charge former configured to deliver fuel charges for combustion in the combustion chamber, the method comprising smoothing the pressure signal, sampling the smoothed signal, and controlling the operation of the charge former based on at least the smoothed signal, wherein determining a value of the engine operation characteristic comprises determining a position of a throttle valve which controls a flow of air through the induction system, and wherein determining the peak crankshaft position comprises reading the peak crankshaft position from a map which includes data regarding a relationship between engine speed, throttle valve position, and peak crankshaft position.

27. An engine comprising an engine body defining at least one combustion chamber therein, an induction system comprising an intake manifold and an intake passage extending from the manifold to the combustion chamber, a pressure sensor assembly configured to detect a pressure of an air flow in the induction system and to output a pressure signal indicative of the pressure detected, the pressure assembly communicating with the intake passage downstream from the intake manifold.

28. The engine as set forth in claim 27 additionally comprising a piston moveably mounted in the engine body and a smoother configured to pressure signal fluctuations corresponding to pressure fluctuations caused by movement of the piston during an intake stroke.

29. The engine as set forth in claim 27 additionally comprising a smoother comprising an elongated conduit connecting the sensor with a point in the intake passage downstream from the intake manifold.

* * * * *